US011065683B2

(12) United States Patent
Boindecker et al.

(10) Patent No.: US 11,065,683 B2
(45) Date of Patent: Jul. 20, 2021

(54) DECORING MACHINE FOR DECORING CAST WORKPIECES, AND METHOD FOR PRODUCING CAST WORKPIECES

(71) Applicant: Fill Gesellschaft m.b.H., Gurten (AT)

(72) Inventors: Alois Boindecker, Gurten (AT); Thomas Murauer, Gurten (AT)

(73) Assignee: Fill Gesellschaft m.b.H., Gurten (AT)

( * ) Notice: Subject to any disclaimer, the term of this patent is extended or adjusted under 35 U.S.C. 154(b) by 0 days.

(21) Appl. No.: 16/764,949

(22) PCT Filed: Nov. 19, 2018

(86) PCT No.: PCT/AT2018/060270
§ 371 (c)(1),
(2) Date: May 18, 2020

(87) PCT Pub. No.: WO2019/100092
PCT Pub. Date: May 31, 2019

(65) Prior Publication Data

US 2020/0346282 A1 Nov. 5, 2020

(30) Foreign Application Priority Data

Nov. 22, 2017 (AT) ..... A 50971/2017

(51) Int. Cl.
*B22D 29/00* (2006.01)
*B06B 1/16* (2006.01)
*B22D 29/02* (2006.01)

(52) U.S. Cl.
CPC ..... *B22D 29/005* (2013.01); *B06B 1/16* (2013.01); *B22D 29/02* (2013.01)

(58) Field of Classification Search
CPC .... B22D 29/00; B22D 29/001; B22D 29/005; B22D 29/02; B06B 1/16
See application file for complete search history.

(56) References Cited

U.S. PATENT DOCUMENTS 5,064,053 A 11/1991 Baker
5,496,167 A 3/1996 Diaz
(Continued)

FOREIGN PATENT DOCUMENTS

AT 3791 U1 8/2000
AT 517 133 A1 11/2016
(Continued)

OTHER PUBLICATIONS

International Search Report of PCT/AT2018/060270, dated Feb. 13, 2019.

*Primary Examiner* — Kevin P Kerns
*Assistant Examiner* — Steven S Ha
(74) *Attorney, Agent, or Firm* — Collard & Roe, P.C.

(57) ABSTRACT

The invention relates to a decoring machine (1) for decoring cast workpieces (2). The decoring machine (1) comprises:

Figure 1:
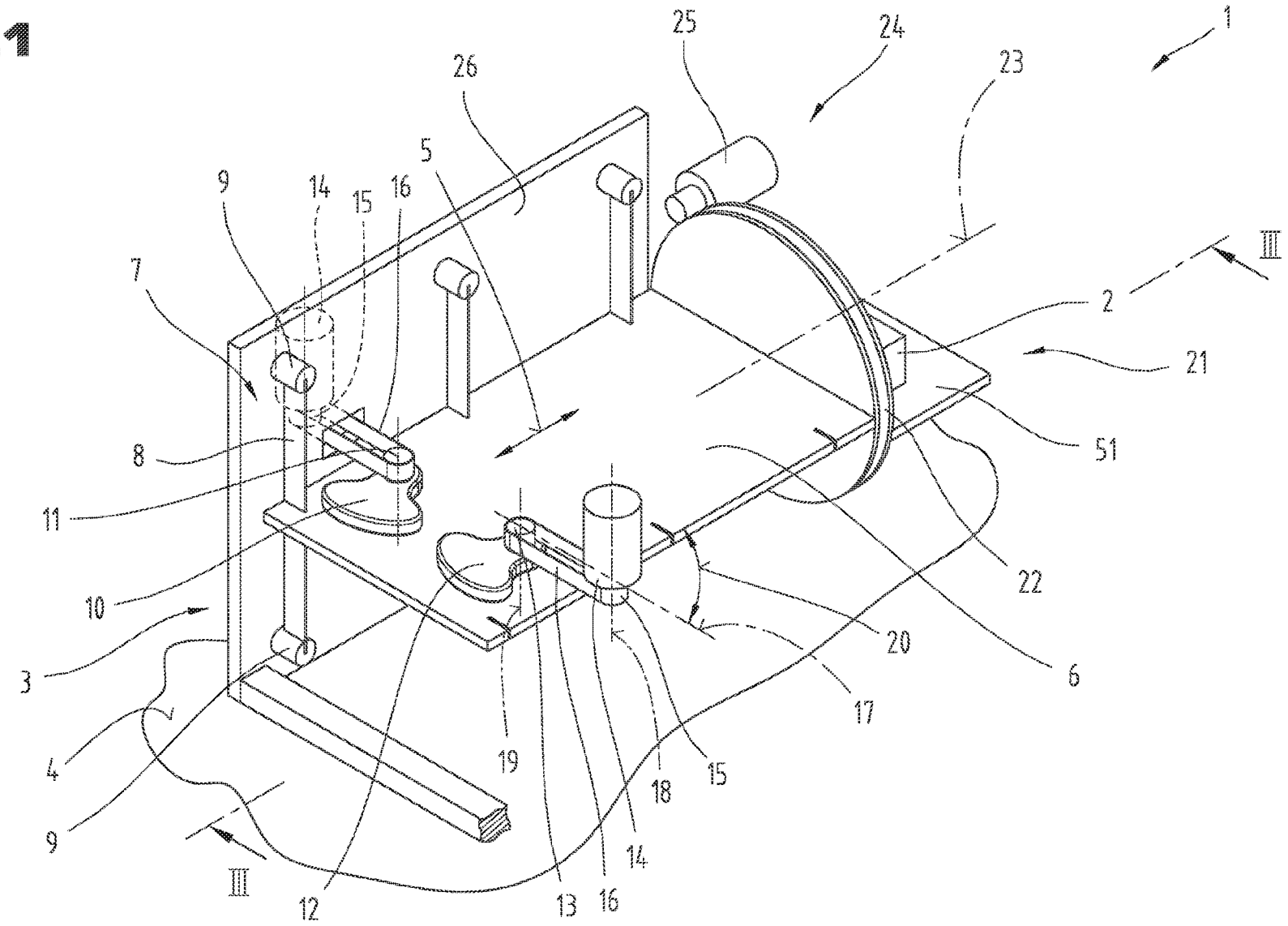

- a machine frame (3);
- a machine table (6), which is coupled to the machine frame (3) by means of a mounting bracket (7);
- a first eccentric mass (10), which is mounted in a rotatable manner on the machine table (6);
- a second eccentric mass (12), which is mounted in a rotatable manner on the machine table (6), wherein the second eccentric mass (12) is driven in the opposite direction to the first eccentric mass (10);
- a workpiece carrier (21) for receiving the cast workpiece (2) to be decored, wherein the workpiece carrier (21) is coupled to the machine table (6) by means of a rotary mounting (22), wherein the rotary mounting (22) is configured in such a way that the workpiece carrier (21) is mounted so as to be rotatable about a horizontal axis of rotation (23) relative to the machine table (6).

18 Claims, 5 Drawing Sheets

(56) References Cited

U.S. PATENT DOCUMENTS

| | | | |
|---|---|---|---|
| 2006/0272792 | A1 | 12/2006 | Massin |
| 2010/0065241 | A1 | 3/2010 | Ichihashi |
| 2015/0336233 | A1 | 11/2015 | Twelves et al. |

FOREIGN PATENT DOCUMENTS

| | | | |
|---|---|---|---|
| CN | 1750897 | A | 3/2006 |
| CN | 101330997 | A | 12/2008 |
| CN | 205519597 | U | 8/2016 |
| DE | 20 2004 021 523 | U1 | 9/2008 |
| DE | 10 2011 015 284 | A1 | 10/2012 |
| EP | 0 304 683 | A2 | 3/1989 |
| JP | 2001-121254 | A | 5/2001 |

DECORING MACHINE FOR DECORING CAST WORKPIECES, AND METHOD FOR PRODUCING CAST WORKPIECES

CROSS REFERENCE TO RELATED APPLICATIONS

This application is the National Stage of PCT/AT2018/060270 filed on Nov. 19, 2018, which claims priority under 35 U.S.C. § 119 of Austrian Application No. A 50971/2017, filed on Nov. 22, 2017, the disclosure of which is incorporated by reference. The international application under PCT article 21(2) was not published in English.

The invention relates to a decoring machine and/or vibrating machine.

A decoring machine/vibrating machine of the mentioned kind is known in principle. AT 517 133 A1A, for example, discloses a decoring machine. The decoring machine comprises a first machine frame, a machine table for clamping a workpiece mounted so as to be movable relative to the first machine frame, two eccentric masses driven in the opposite direction and mounted on the machine table as well as at least one drive motor arranged on the first machine frame. Here, a flux of force and/or torque from the at least one drive motor to the two eccentric masses is directed in such a way that a branch and/or a junction in the flux of force/flux of torque and/or means for synchronizing the two eccentric masses are arranged at the first machine frame. In addition, the relative flux of force/flux of torque between the first machine frame and the machine table is directed via at least one belt leading to an eccentric mass.

It is disadvantageous in this arrangement that the transmission for synchronizing the two eccentric shafts and/or eccentric masses is exposed to intense vibrations and the decoring machine/vibrating machine therefore has only a relatively short life span. Furthermore, when the first machine frame is rotated, gyroscopic forces caused by the rotating eccentric masses act upon same.

It is therefore an object of the invention to specify an improved decoring machine/vibrating machine.

This object is achieved by a decoring machine as described in the claims.

According to the invention, a decoring machine for decoring cast workpieces is provided. The decoring machine comprises:

- a machine frame, which is installable at a machine base;
- a machine table, which is coupled to the machine frame by means of a mounting bracket, wherein the machine table is mounted by means of the mounting bracket so as to be movable at least in a main direction of movement relative to the machine frame;
- a first eccentric mass, which is mounted in a rotatable manner on the machine table;
- a second eccentric mass, which is mounted in a rotatable manner on the machine table, wherein the second eccentric mass is driven in the opposite direction to the first eccentric mass;
- a workpiece carrier for receiving the cast workpiece to be decored, characterized in that the workpiece carrier is coupled to the machine table by means of a rotary mounting, wherein the rotary mounting is configured in such a way that the workpiece carrier is mounted so as to be rotatable about a horizontal axis of rotation relative to the machine table.

The decoring machine of the invention has the advantage that the workpiece carrier can be rotated relative to the machine table by means of the rotary mounting. Therefore, it is not necessary to rotate the entire machine table in order to tilt the cast workpiece. Here, the particular advantage lies in the fact that the eccentric masses need not be rotated to stimulate the oscillating movement of the machine table, which would lead to the introduction of gyroscopic forces into the machine table.

Furthermore, it can be expedient if the mounting bracket comprises a leaf spring, wherein the leaf spring is coupled to the machine frame at its two longitudinal ends by means of a revolute joint and to the machine table in the area of its longitudinal center. In particular, it can here be provided that the revolute joints, at which the leaf spring is accommodated, have a rubber buffer, so that a shortening of the leaf spring, which occurs due to the deflection, can be compensated for. It is of advantage here that such a leaf spring is well-suited to absorb the oscillations.

In particular, it can be provided that the leaf spring is incorporated in the decoring machine in a perpendicularly upright position. It can thus be achieved that the leaf springs are charged largely with tensile/compressive and/or bending stresses.

It can furthermore be provided that the rotary mounting is configured in the form of a slewing ring. It is of advantage here that the slewing ring can absorb high bending moments around the axis of rotation and, at the same time, can have a low-cost structure.

Furthermore, it can be provided that a rotary drive is configured, by means of which the workpiece carrier is rotatable relative to the machine table. Through this measure, the workpiece carrier can be rotated automatically relative to the machine table.

Also advantageous is an embodiment according to which it can be provided that the rotary drive comprises a drive motor having a rotary drive pulley and a traction means slung around the rotary drive pulley, wherein the drive motor is accommodated at the machine frame, wherein the traction means is coupled to the workpiece carrier. It is of advantage here that, through this measure, the drive motor of the rotary drive is not exposed to any oscillation and the drive motor can thus have an extended life span.

According to a further development, it is possible for the traction means to have a first longitudinal end and a second longitudinal end, wherein the first longitudinal end and the second longitudinal end are respectively connected to the workpiece carrier and wherein the rotary drive pulley is arranged between the first longitudinal end and the second longitudinal end. In such an embodiment, the first longitudinal end and the second longitudinal end of the traction means are connected to the workpiece carrier, whereby no toothing is required at the workpiece carrier to engage the traction means with the workpiece carrier.

It may furthermore be expedient if at least one of the eccentric masses is coupled to an eccentric drive motor, wherein the eccentric drive motor is arranged at the machine frame. It is of advantage here that the eccentric drive motor is not exposed to any oscillation and can thus have an extended life span.

Furthermore, it can be provided that a drive pulley is arranged at the eccentric drive motor and a driven pulley is arranged at the eccentric mass, wherein a drive belt is slung around the drive pulley and the driven pulley, wherein a straight line drawn between the axis of rotation of the drive pulley and the axis of rotation of the driven pulley is at an angle of between 85° and 95° to the main direction of movement of the machine table. Through this measure, the oscillating movement of the machine table in the main direction of movement can be prevented from resulting in a damaging elongation and/or in an introduction of force into the drive belt.

Furthermore, it can be provided that the two eccentric masses are rotationally connected to each other by means of a synchronization means. It is of advantage here that only one of the two eccentric masses need be driven by an eccentric drive motor and the second eccentric mass can be operated by means of the synchronization means in the opposite direction of rotation but at a rotational speed that is synchronized with the first eccentric mass.

Evidently, it is also possible for each of the eccentric masses to be coupled to an eccentric drive motor and for a synchronization means for mechanical synchronization of the two eccentric masses to be provided in addition.

According to a particular embodiment, it is possible for the first eccentric mass to be coupled to a first synchronization disc and for the second eccentric mass to be coupled to a second synchronization disc, wherein the synchronization means comprises a synchronization belt, which is deflected around deflection sheaves in such a way that an interior side of the synchronization belt is in operative connection with the first synchronization disc and an exterior side of the synchronization belt is in operative connection with the second synchronization disc. Such synchronization by means of a synchronization belt can be realized at low cost and can furthermore have a high degree of robustness.

As an alternative to this, it can be provided that the synchronization means is formed by a first gear coupled to the first eccentric mass and a second gear coupled to the second eccentric mass. The two gears are in direct engagement with each other.

According to an advantageous further development, it can be provided that at least one decoring hammer, in particular a hydraulically acting decoring hammer, is arranged at the workpiece carrier, which decoring hammer has a hammer head configured to act upon a workpiece. The decoring hammer can be used to act upon the cast workpiece in addition to the vibrating movement of the machine table. In this way, the sand cores can be more easily broken and/or removed from the cast workpieces.

In particular, it can be advantageous for the decoring hammer to be arranged at the workpiece carrier in such a way that an effective direction of the decoring hammer is parallel to the main direction of movement. It is of advantage here that, through this measure, the acceleration forces acting upon the decoring hammer are in the effective direction of the decoring hammer and do therefore not constitute an overload on the decoring hammer.

It can furthermore be provided that the decoring hammer is shiftable relative to the workpiece carrier in a direction transverse to the main direction of movement.

It can furthermore be provided that the decoring hammer is shiftable relative to the workpiece carrier in the main direction of movement. Through this measure, the flexibility of the decoring machine can be improved, so that different cast workpieces can be decored on the decoring machine.

Also advantageous is an embodiment according to which it can be provided that two decoring hammers are arranged at the workpiece carrier, wherein the workpiece carrier has a supporting table mounted to a base frame of the workpiece carrier by means of a pendulum bearing. By means of the pendulum bearing, measuring tolerances of the cast workpiece can be compensated for, so that both decoring hammers can act evenly upon the cast workpiece.

According to a further development, it is possible for a brake to be configured, by means of which the machine table can be braked relative to the machine frame. The brake can be used to slow down the machine table after the decoring process has finished, so that a new cast workpiece can be inserted after a short period of time. Furthermore, the brake can be activated during the start-up process, so that any critical natural frequencies can be overcome as quickly as possible.

According to the invention, a method for decoring cast workpieces by means of a decoring machine according to any one of the preceding claims is further provided. The method comprises the following process steps:

clamping the cast workpiece at the workpiece carrier;

vibrating the cast workpiece by moving the machine table including the workpiece carrier in the main direction of movement relative to the machine frame;

removing the molding sand from the cast workpiece by rotating the workpiece carrier about a horizontal axis of rotation relative to the machine table.

Furthermore, it can be provided that, during the vibrating of the cast workpiece by moving the machine table including the workpiece carrier in the main direction of movement relative to the machine frame, the cast workpiece is simultaneously acted upon by means of at least one of the decoring hammers. It is of advantage here that the decoring process can be accelerated through this measure.

It can furthermore be expedient if the machine table has a top tabletop and a bottom tabletop, which are arranged spaced apart from each other, wherein the eccentric mass is arranged between the two tabletops.

Furthermore, it can be advantageous if the two synchronization discs are arranged outside the top or bottom tabletop. It can furthermore be provided that the driven pulley is arranged outside the opposite tabletop.

Furthermore, it can be provided that the first eccentric mass is arranged at a first shaft and the second eccentric mass is arranged at a second shaft, wherein the first shaft and the second shaft are respectively mounted by means of a first bearing arranged within the top tabletop and a second bearing arranged within the bottom tabletop.

Furthermore, it can be provided that the eccentric drive motor is arranged at the machine frame and is not moved relative to the machine base during operation of the decoring machine.

Furthermore, it can be provided that the workpiece carrier has a clamping device for fixing the cast workpiece in position.

It can furthermore be provided that the supporting table is positioned in such a way that the center of gravity of the entire workpiece carrier including the cast workpiece is located at the level of the horizontal axis of rotation.

For the purpose of a better understanding of the invention, the latter will be elucidated in more detail by means of the figures below.

Figure 2:
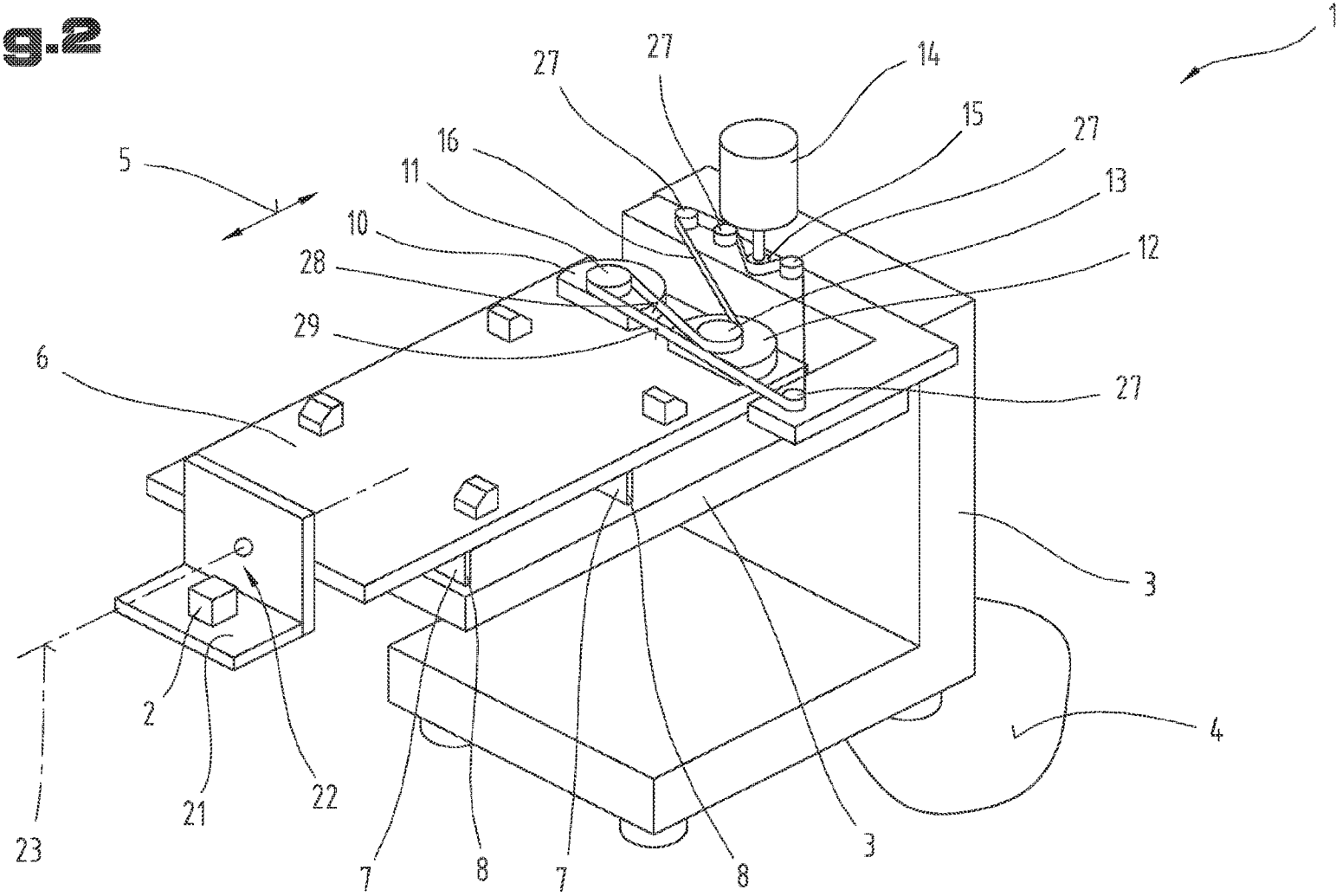
Figure 5:
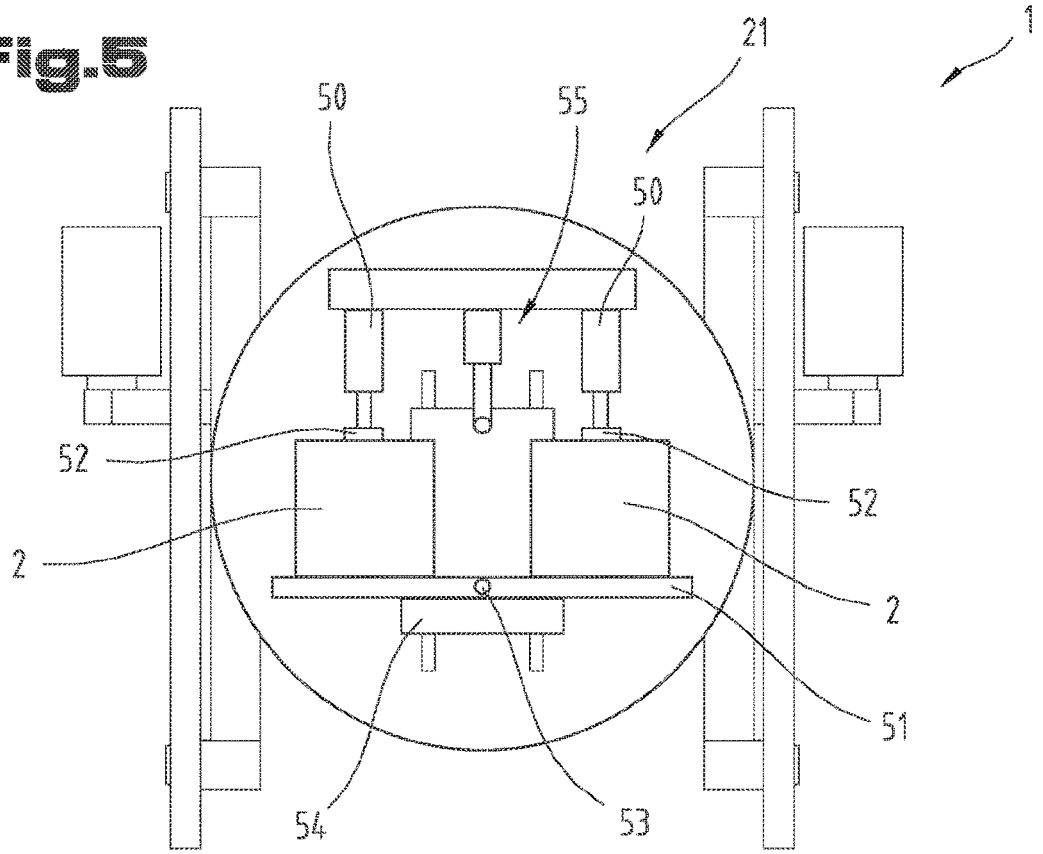
Figure 6:
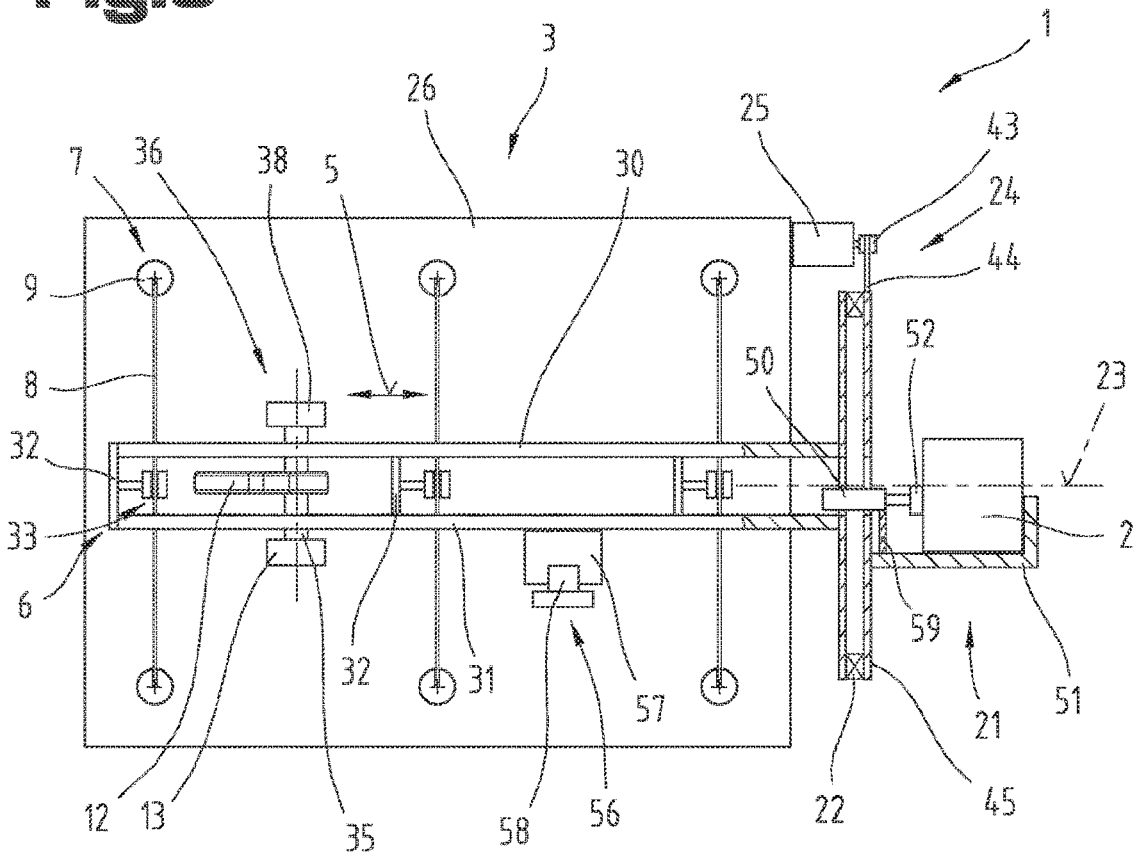

In a strongly simplified, schematic depiction, each figure shows as follows:

FIG. 1 a perspective view of a first exemplary embodiment of a decoring machine;

FIG. 2 a perspective view of another exemplary embodiment of a decoring machine;

FIG. 3 a lateral view of an exemplary embodiment of a decoring machine;

FIG. 4 various variant embodiments of the rotary drive of the decoring machine;

FIG. 5 a front view of an exemplary embodiment of the decoring machine;

FIG. 6 a lateral view of another exemplary embodiment of a decoring machine.

First of all, it is to be noted that, in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, and these specifications of location are to be analogously transferred to the new position.

FIG. 1 shows an oblique view of a first exemplary embodiment of a decoring machine 1, which can also be referred to as vibrating machine. The decoring machine 1 serves to remove the core from cast workpieces 2. The decoring machine 1 comprises a machine frame 3, which can be and/or is installed at a machine base 4. Furthermore, the decoring machine 1 comprises a machine table 6 for clamping the cast workpiece 2 mounted so as to be movable relative to the machine frame 3 in a main direction of movement 5. Here, the machine table 6 is movably mounted at the machine frame 3 by means of a mounting bracket 7.

As can be gleaned from the present exemplary embodiment, it can be provided that the mounting bracket 7 comprises a leaf spring 8, which is coupled to the machine frame 3 at both longitudinal ends by means of a revolute joint 9. Here, the revolute joints 9 can be arranged at the machine frame 3 and the leaf spring 8 can be secured in the revolute joint 9. The leaf spring 8 can be coupled to the machine table 6 in the area of the latter's longitudinal center. This can be achieved, for example, by means of clamping jaws, or by screwing together the leaf spring 8 and the machine table 6.

The decoring machine 1 further comprises a first eccentric mass 10, which is mounted in a rotatable manner on the machine table 6, wherein the first eccentric mass 10 is coupled to a first driven pulley 11.

Furthermore, the decoring machine 1 in the present exemplary embodiment comprises a second eccentric mass 12, which is mounted in a rotatable manner on the machine table 6, wherein the second eccentric mass 12 is coupled to a second driven pulley 13. The second eccentric mass 12 is driven in the opposite direction to the first eccentric mass 10.

In the present exemplary embodiment, the first eccentric mass 10 and the second eccentric mass 12 are respectively coupled to an eccentric drive motor 14. Here, a drive pulley 15 is arranged at the respective eccentric drive motor 14, which driven pulley 15 is coupled to the driven pulley 11, 13 by means of a drive belt 16. Here, a toothed belt, for example, can be used as a drive belt 16.

In particular, it can be provided that the eccentric drive motor 14 is arranged at the machine frame 3 and is therefore not moved together with the machine table 6. Through this measure, the life span of the eccentric drive motor 14 can be extended.

Furthermore, it can be provided that a straight line 17, which extends between an axis of rotation 18 of the drive pulley 15 and an axis of rotation 19 of the driven pulley 11, 13, is arranged at an angle 20 to the main direction of movement 5. The angle 20 is preferably 90°.

In the present exemplary embodiment, the two eccentric masses 10, 12 can respectively be driven independently of each other by the respectively allocated eccentric drive motor 14.

Here, the two eccentric drive motors 14 can be controlled in such a way that the eccentric masses 10, 12 are rotated in the opposite direction of rotation in a manner synchronized with each other.

As can be further gleaned from FIG. 1, it can be provided that a workpiece carrier 21 for receiving the cast workpiece 2 is provided. The workpiece carrier 21 can be rotated about a horizontal axis of rotation 23 relative to the machine table 6 by means of a rotary mounting 22. Here, the horizontal axis of rotation 23 can be arranged parallel to the main direction of movement 5.

Due to the pivotability of the workpiece carrier 21, the cast workpiece 2 can be turned upside down and/or laterally pivoted, so that the molding sand located in the cast workpiece 2 can be removed from the cast workpiece 2 by gravitational action.

As can be gleaned from FIG. 1, during operation of the decoring machine 1 the machine table 6 is set into oscillation in the main direction of movement 5 by the eccentric masses 10, 12. This relative movement between the machine table 6 and the machine frame 3 can be achieved by the flexible mounting bracket 7 of the machine table 6.

In particular, it can be provided that the machine table 6 oscillates at an amplitude of between +/−2 mm to +/−15 mm Δn amplitude of +/−4 mm to +/−8 mm has proven advantageous.

As the workpiece carrier 21 is coupled to the machine table 6 by means of the rotary mounting 22, also the workpiece carrier 21 will oscillate together with the machine table 6 at the same amplitude. The rotary mounting 22 as a connecting component between the machine table 6 and the workpiece carrier 21 will therefore naturally also oscillate in the main direction of movement 5.

Furthermore, a rotary drive 24 is depicted schematically, which serves to rotate the workpiece carrier 21 relative to the machine table 6. Here, the rotary drive 24 can have a drive motor 25, for example, which is coupled to the machine table 6 and/or arranged at same. It can therefore be provided that the drive motor 25 equally oscillates in the main direction of movement 5 together with the machine table 6. In such an exemplary embodiment, the rotary drive 24 can be coupled to the workpiece carrier 21 by means of a gear connection, for example.

As can be gleaned from FIG. 1, it can be provided that the machine frame 3 has two side parts 26, at which the revolute joints 9 of the mounting bracket 7 are arranged. For the sake of clarity, in FIG. 1 the side part 26 closest to a potential observer as well as the mounting brackets 7 arranged at same are blanked out. It is, however, obvious to the person skilled in the art that the non-depicted side part 26 with the non-depicted mounting brackets 7 is provided in a configuration mirrored to the components shown.

In the FIG. 2, a further and, if applicable, independent embodiment of the decoring machine 1 is shown, wherein, again, equal parts are provided with equal reference numbers and/or equal component designations as in the preceding FIG. 1. In order to avoid unnecessary repetition, mention and/or reference is made of and/or to the detailed description in the preceding FIG. 1.

As can be gleaned from FIG. 2, it can be provided that the leaf springs 8 of the mounting bracket 7 are connected directly to the machine table 6 at their first longitudinal end and are connected directly to the machine frame 3 at their second longitudinal end. Also in this exemplary embodiment, the machine table 6 can be coupled to the machine frame 3 by means of multiple mounting brackets 7.

As can be further gleaned from this exemplary embodiment, it can be provided that both the first driven pulley 11 of the first eccentric mass 10 and the second driven pulley 13 of the second eccentric mass 12 are wrapped by only one drive belt 16, which drive belt 16 is coupled to a drive pulley 15 of the eccentric drive motor 14. This means that only one single eccentric drive motor 14 need be provided for driving both eccentric masses 10, 12. However, such a drive situation for driving the eccentric masses 10, 12 is not limited to the exemplary embodiment shown but can be provided independently of the configuration of the mounting brackets 7.

In particular, it can be provided that the eccentric drive motor 14 is accommodated at the machine frame 3 and therefore stands still relative to the machine base 4 and/or is mounted via damping elements and can therefore have little movement. Furthermore, multiple deflection sheaves 27 can be provided, around which the drive belt 16 is guided in such a way that an interior side 28 of the drive belt 16 rests against the first driven pulley 11 and an exterior side 29 of the drive belt 16 rests against the second driven pulley 13. Through this measure, it can be achieved that the two eccentric masses 10, 12 are driven in the opposite direction of rotation.

In the FIG. 3, a further and, if applicable, independent embodiment of the decoring machine 1 is shown, wherein, again, equal parts are provided with equal reference numbers and/or equal component designations as in the preceding FIGS. 1 and 2. In order to avoid unnecessary repetition, mention and/or reference is made of and/or to the detailed description in the preceding FIGS. 1 and 2.

Figure 3A:
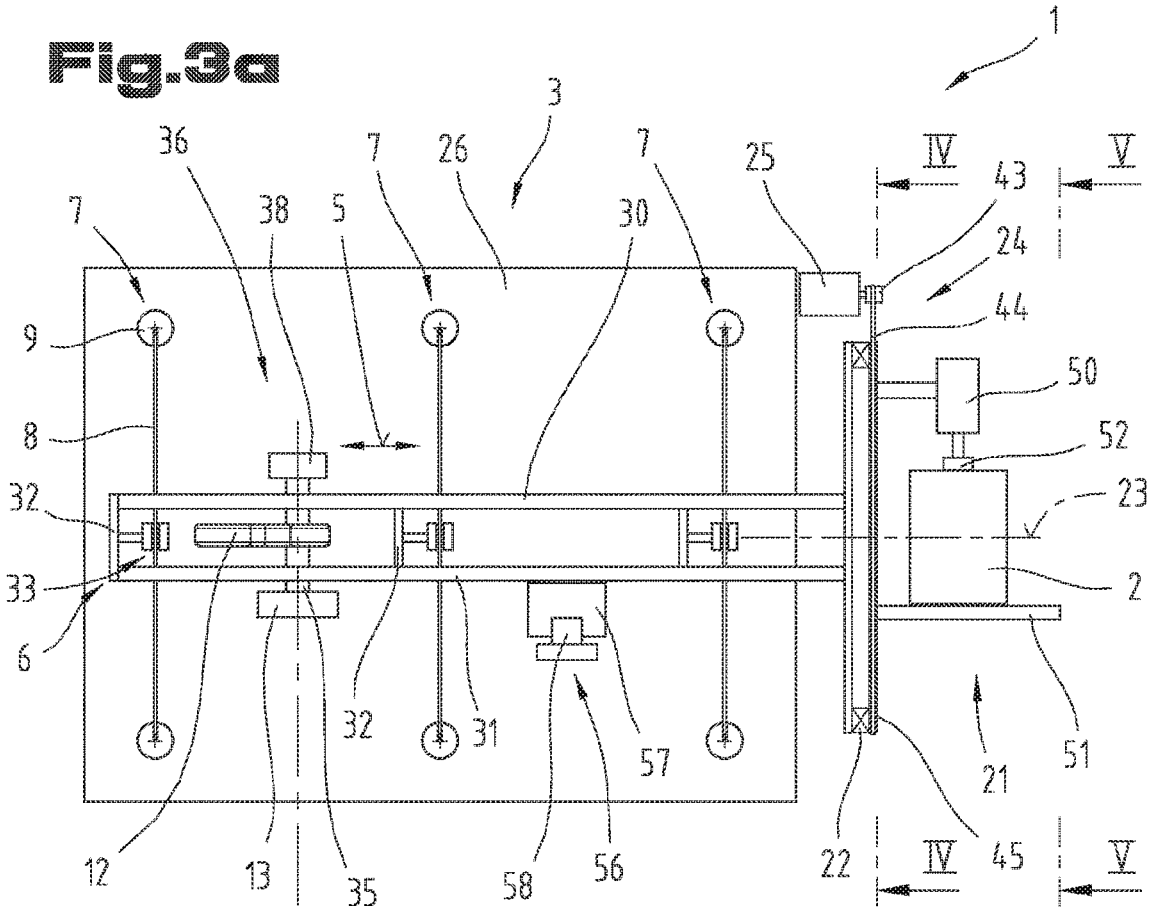

FIG. 3*a* shows a lateral view of the decoring machine 1, wherein a view in accordance with line of FIG. 1 was selected. Similarly to the exemplary embodiment of the FIG. 1, the exemplary embodiment of FIG. 3 has a machine frame 3, which equally has two side parts 26.

Figure 3B:
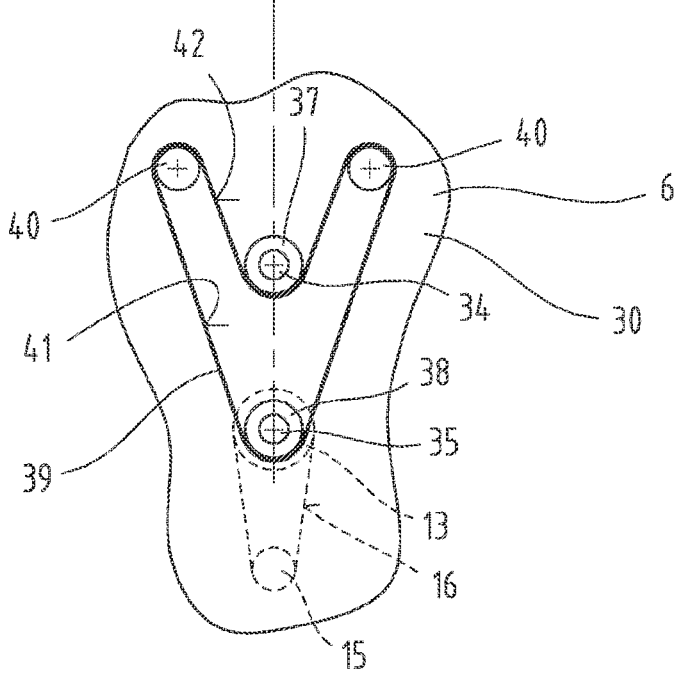

For the sake of clarity, the side part 26 closest to a potential observer was blanked out here too. In FIG. 3*b*, a plan view pertaining to the side view of a part of the decoring machine 1 is depicted, wherein only the drive situation of the eccentric masses 10, 12 is depicted in this figure.

As can be gleaned from FIG. 3, it can be provided that the machine table 6 has a top tabletop 30 and a bottom tabletop 31, which are coupled to each other by means of connecting elements 32. Here, the machine table 6 can be configured as a cast construction, for example. Alternatively, it is also conceivable that the machine table 6 is configured as a welded construction. In yet another variant embodiment, it is also conceivable that the machine table 6 is configured as a screwed construction. In particular, it can be provided that the machine table 6 or at least a large part of its individual components are formed by aluminum.

Furthermore, clamping jaws 33 can be provided, by means of which the machine table 6 can be arranged centered at the leaf springs 8. Furthermore, it can be provided that a first shaft 34 is configured, which extends between the top tabletop 30 and the bottom tabletop 31. Analogously, it can be provided that a second shaft 35 is configured, which equally extends between the top tabletop 30 and the bottom tabletop 31. The first shaft 34 serves for receiving the first eccentric mass 10. The second shaft 35 serves for receiving the second eccentric mass 12. In particular, it can be provided that the two eccentric masses 10, 12 are arranged respectively between the top tabletop 30 and the bottom tabletop 31.

Furthermore, it can be provided that at least at one of the two shafts 34, 35 a driven pulley 11, 13 is arranged, which can be coupled to the eccentric drive motor 14.

In the present exemplary embodiment, only the second driven pulley 13 is arranged at the second shaft 35, which second driven pulley 13 is coupled to the drive pulley and thus the eccentric drive motor 14 by means of the drive belt 16. As can be gleaned from the exemplary embodiment of FIG. 3, it can be provided that the second driven pulley 13 is arranged below the bottom tabletop 31.

The driven pulley 11, 13 and the eccentric masses 10, 12 may also be arranged at the shaft 34, 35 at any other location.

As only one of the two shafts 34, 35 is coupled to the eccentric drive motor 14 in the present exemplary embodiment, a synchronization means 36 is provided, by means of which the first shaft 34 is coupled to the second shaft 35.

As can be gleaned from the present exemplary embodiment, it can be provided, for example, that the synchronization means 36 has a first synchronization disc 37 arranged at the first shaft 34 and has a second synchronization disc 38 arranged at the second shaft 35. Furthermore, a synchronization belt 39 can be provided, which is slung around the first synchronization disc 37 around the second synchronization disc 38 and serves for synchronizing the two shafts 34, 35 and therefore the two eccentric masses 10, 12.

In order to achieve an opposite direction of rotation of the two eccentric masses 10, 12, it can be provided that the synchronization belt 39 is additionally guided around deflection sheaves 40, so that an interior side 41 of the synchronization belt 39 rests against the second synchronization disc 38 and an exterior side 42 of the synchronization belt 39 rests against the first synchronization disc 37. Evidently, the deflection sheaves 40 can also be arranged in the area of the second synchronization disc 38, so that the interior side 41 of the synchronization belt 39 rests against the first synchronization disc 37 and its exterior side 42 rests against the second synchronization disc 38. The arrangement of the synchronization means 36 is schematically depicted in FIG. 3 in a plan view in addition to the lateral view.

In an exemplary embodiment not depicted, it can also be provided that a gear is respectively arranged at the first shaft 34 and at the second shaft 35, wherein the two gears are in engagement with each other and an opposite direction of rotation of the two shafts 34, 35 is thereby achieved.

Also in FIG. 3, another exemplary embodiment of the connection of the workpiece carrier 21 to the machine table 6 is depicted.

As can be gleaned from FIG. 3, it can be provided that the rotary mounting 22 is configured in the form of a slewing ring, which is inserted between the machine table 6 and the workpiece carrier 21 and/or by means of which the workpiece carrier 21 is accommodated at the machine table 6. Furthermore, it can be provided that the rotary drive 24 has a rotary drive pulley 43 for rotating the workpiece carrier 21, which rotary drive pulley 43 is arranged at the drive motor 25 and wrapped by a traction means 44. The traction means 44 can be configured in the form of a toothed belt, for example, which serves for the transmission of torque between the rotary drive pulley 43 and a workpiece support disc 45.

As can be gleaned from FIG. 3, it can be provided that the drive motor 25 of the rotary drive 24 is coupled to the machine frame 3 and/or is directly mounted to same, and therefore also the drive motor 25 stands still relative to the machine base 4. The relative axial movement thus caused between the rotary drive pulley 43 and the workpiece support disc 45 can be compensated for by means of the traction means 44.

In the FIG. 4, a further and, if applicable, independent embodiment of the decoring machine 1 is shown, wherein, again, equal parts are provided with equal reference numbers and/or equal component designations as in the preceding FIGS. 1 to 3. In order to avoid unnecessary repetition, mention and/or reference is made of and/or to the detailed description in the preceding FIGS. 1 to 3.

In the FIGS. 4*a* to 4*d*, various exemplary embodiments of the rotary drive 24 are depicted in a lateral view in accordance with the intersection line IV-IV of FIG. 3. These are schematic, highly simplified depictions exclusively of the rotary drive 24.

Figure 4B:
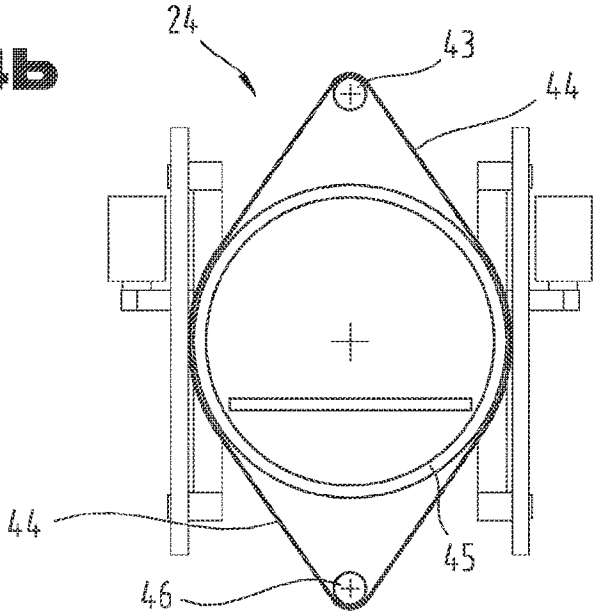
Figure 4D:
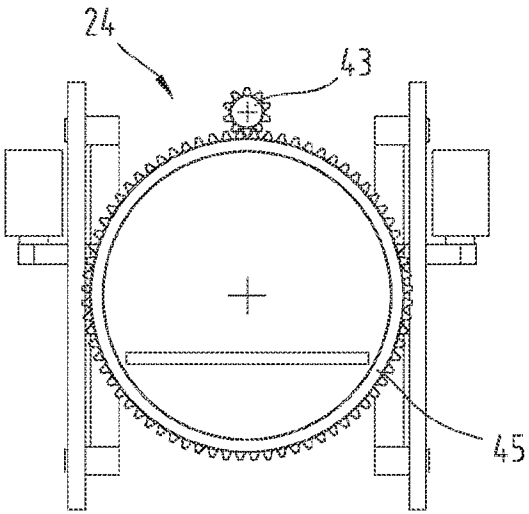
Figure 4A:
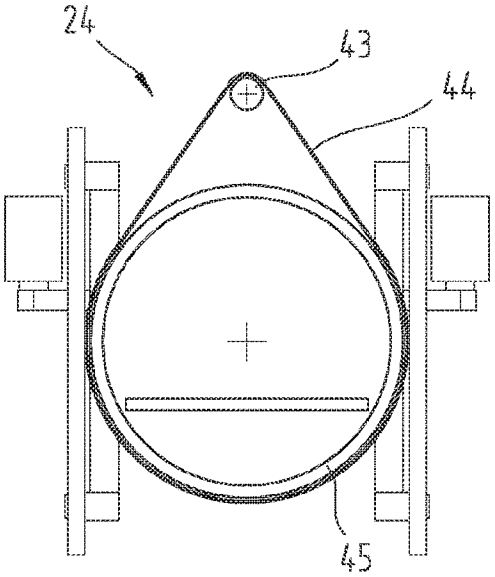

In the FIG. 4*a*, the same drive situation is depicted as it is shown in FIG. 3. As can be gleaned from FIG. 4*a*, it can be provided that the traction means 44 is configured as an endless belt, which is slung both around the rotary drive pulley 43 and around the workpiece support disc 45.

In the FIG. 4*b*, another exemplary embodiment of the rotary drive 24 is depicted, wherein the traction means 44 is additionally slung around a counterholder pulley 46 at the side opposite the rotary drive pulley 43. By means of the counterholder pulley 46, it can be achieved that the traction means 44 does not exert a pulling force on the workpiece support disc 45.

In the exemplary embodiments of FIG. 4*a* and FIG. 4*b*, the workpiece support disc 45 preferably has toothing on the outside, which interacts with a traction means 44 configured as a toothed belt.

Figure 4C:
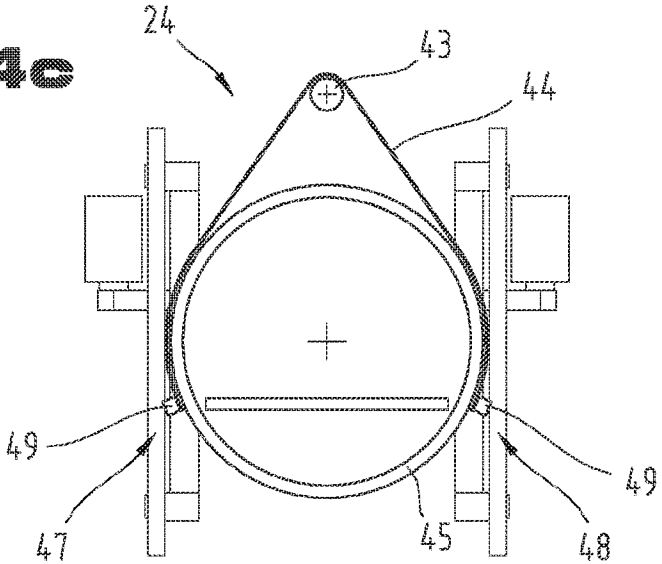

In FIG. 4*c*, another exemplary embodiment of the rotary drive 24 is depicted. As can be gleaned from FIG. 4*c*, it can be provided that the traction means 44 is not configured as an endlessly revolving traction means as shown in the FIGS. 4*a* and *b* but has a first longitudinal end 47 and a second longitudinal end 48. Here, the first longitudinal end 47 and the second longitudinal end 48 can respectively be mounted to the workpiece support disc 45 by means of a clamping jaw 49. Here, the function of the rotary drive 24 is the same as in the rotary drive 24 depicted in FIG. 4*a*. In the exemplary embodiment of FIG. 4, the workpiece support disc 45 need not have toothing on the outside. This is rendered possible by the connection by means of the clamping jaws 49.

In the FIG. 4*d*, another exemplary embodiment of the rotary drive 24 is depicted, which has already been depicted in FIG. 1. As can be gleaned from FIG. 4*d*, it can be provided that the rotary drive pulley 43 is configured as a gear, for example, which rotary drive pulley 43 is in direct engagement with the workpiece support disc 45, which in this exemplary embodiment equally has toothing on the outside. Here, different types of toothing, such as involute toothing or cage gear toothing, can be provided.

Alternatively, the toothing can also be configured on the inside at the workpiece support disc 45, wherein the workpiece support disc 45 can accordingly be configured as a ring gear. In such a configuration of the workpiece support disc 45, the rotary drive pulley 43 can be arranged on the inside at the workpiece support disc 45.

As can be gleaned from FIG. 3, it can be provided that the workpiece carrier 21 has a supporting table 51, at which the cast workpiece 2 can be received.

The supporting table 51 is preferably positioned in such a way that the center of gravity of the entire workpiece carrier 21 including the cast workpiece 2 is located at the level of the horizontal axis of rotation 23. Through this measure, the torque to be generated by the drive motor 25 can be kept as low as possible. Furthermore, this measure prevents an overturning moment from being introduced into the machine table 6 through the oscillating movement of the workpiece carrier 21 in the main direction of movement 5.

As can be further gleaned from FIG. 3, it can be provided that the decoring machine 1 has a decoring hammer 50, which is equally arranged at the workpiece carrier 21 and is therefore rotatable with respect to the horizontal axis of rotation 23 relative to the machine table 6 together with the workpiece carrier 21. The decoring hammer 50 has a stamp 52, which is brought in flush contact with the cast workpiece 2 and acts upon the cast workpiece 2 in a hammering manner By means of the decoring hammer 50, the decoring effect of the decoring machine 1 can be improved. The stamp 52 of the decoring hammer 50 can simultaneously serve to clamp the cast workpiece 2 at the supporting table 51.

As can be further gleaned from FIG. 3, it can be provided that a brake 56 is configured, by means of which the oscillating movement of the machine table 6 can be braked relative to the machine frame 3. The brake 56 can be used to bring the decoring machine 1 to a halt in a short space of time, so that a new cast workpiece 2 can be inserted in the decoring machine 1 after the decoring process has finished.

As can be gleaned from FIG. 3, the brake 56 can comprise two brake shoes 58, which can be engaged with a brake backplate 57 and can thus prevent a relative movement between the brake shoes 58 and the brake backplate 57. Here, the brake backplate 57 can be arranged at the machine frame 6 and therefore oscillate together with same. The brake shoes 58 can be arranged at the machine frame 3 and therefore stand still.

Evidently, in an alternative variant embodiment the brake shoes 58 can also be arranged at the machine frame 6 and the brake backplate 57 can be arranged at the machine frame 3.

In the FIG. 5, a further and, if applicable, independent embodiment of the decoring machine 1 is shown, wherein, again, equal parts are provided with equal reference numbers and/or equal component designations as in the preceding FIGS. 1 to 4. In order to avoid unnecessary repetition, mention and/or reference is made of and/or to the detailed description in the preceding FIGS. 1 to 4.

FIG. 5 shows a schematic front view of the decoring machine 1 in accordance with line V-V of FIG. 3. In FIG. 5, a possible exemplary embodiment of the decoring hammer 50 is depicted.

As can be gleaned from FIG. 5, it can be provided that the supporting table 51, on which the cast workpiece(s) 2 rest, are arranged at a base frame 54 in a manner tiltable by means of a pendulum bearing 53. This is of advantage in particular whenever two decoring hammers 50 are configured. Through this measure, two cast workpieces 2 can be mounted to the supporting table 51, wherein the clamping force acting upon the cast workpieces 2 is commensurate due to the pendulum bearing 53.

Furthermore, it can be provided that an feeding cylinder 55 is configured, by means of which the supporting table 51 can be shifted relative to the decoring hammers 50. Through this measure, cast workpieces 2 of different heights can be clamped in the workpiece carrier 21.

In the FIG. 6, a further and, if applicable, independent embodiment of the decoring machine 1 is shown, wherein, again, equal parts are provided with equal reference numbers and/or equal component designations as in the preceding FIGS. 1 to 5. In order to avoid unnecessary repetition, mention and/or reference is made of and/or to the detailed description in the preceding FIGS. 1 to 5.

FIG. 6 shows another exemplary embodiment of the workpiece carrier 21 similar to the view in FIG. 3, yet wherein only the workpiece carrier 21 and the components connected with it are depicted. As can be gleaned from FIG. 6, it can be provided that the supporting table 51 is configured in an L-shape and/or has a counterholder plate and that the decoring hammer 50 acts in a horizontal direction parallel to the horizontal axis of rotation 23. In such an exemplary embodiment, the cast workpiece 2 can be more easily inserted in the supporting table 51, as the decoring hammer 50 is not in the way when inserting the cast workpiece 2. In this way, the supporting table 51 is easily accessible from the top, whereby the cast workpiece 2 can be inserted in the supporting table 51, for example by means of a crane or by means of a manipulator robot.

The decoring hammer 50 can be coupled to the supporting table 51 by means of a holding 59.

In particular, it can be provided that the rotary mounting 22 and/or the accommodation of the rotary mounting 22 is configured in such a hollow cylindrical manner that the decoring hammer 50 can protrude through the rotary mounting 22. In this way, the decoring machine 1 can be built as compact and space-saving as possible. Furthermore, it is possible through the hollow cylindrical configuration of the rotary mounting 22 that various media lines are guided through the centrally positioned hollow.

The exemplary embodiments show possible embodiment variants, and it should be noted in this respect that the invention is not restricted to these particular depicted embodiment variants of it, but that rather various combinations of the individual embodiment variants with each other are possible and this possibility of variants based on the technical teaching by means of the invention at issue lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

Any and all specifications of value ranges in the present description are to be understood to comprise any and all sub-ranges of same, for example the specification 1 to 10 is to be understood to mean that any and all sub-ranges starting from the lower limit 1 and from the upper limit 10 are comprised therein, i.e. any and all sub-ranges start at a lower limit of 1 or larger and end at an upper limit of 10 or less, e.g. 1 to 1.7, or 3.2 to 8.1, or 5.5 to 10.

Finally, as a matter of form, it should be noted that for ease of understanding of the structure, elements are partially not depicted to scale and/or are enlarged and/or are reduced in size.

| List of Reference Numbers | |
|---|---|
| 1 | decoring machine |
| 2 | cast workpiece |
| 3 | machine frame |
| 4 | machine base |
| 5 | main direction of movement |
| 6 | machine table |
| 7 | mounting bracket |
| 8 | leaf spring |
| 9 | revolute joint |
| 10 | first eccentric mass |

-continued

| List of Reference Numbers | |
|---|---|
| 11 | first driven pulley |
| 12 | second eccentric mass |
| 13 | second driven pulley |
| 14 | eccentric drive motor |
| 15 | drive pulley |
| 16 | drive belt |
| 17 | straight line |
| 18 | axis of rotation of drive pulley |
| 19 | axis of rotation of driven pulley |
| 20 | angle |
| 21 | workpiece carrier |
| 22 | rotary mounting |
| 23 | horizontal axis of rotation |
| 24 | rotary drive |
| 25 | drive motor |
| 26 | side part |
| 27 | deflection sheave |
| 28 | drive belt interior side |
| 29 | drive belt exterior side |
| 30 | upper tabletop |
| 31 | lower tabletop |
| 32 | connecting element |
| 33 | clamping jaw |
| 34 | first shaft |
| 35 | second shaft |
| 36 | synchronization means |
| 37 | first synchronization disc |
| 38 | second synchronization disc |
| 39 | synchronization belt |
| 40 | deflection sheave |
| 41 | synchronization belt interior side |
| 42 | synchronization belt exterior side |
| 43 | rotary drive pulley |
| 44 | traction means |
| 45 | workpiece support disc |
| 46 | counterholder pulley |
| 47 | first longitudinal end |
| 48 | second longitudinal end |
| 49 | clamping jaws |
| 50 | decoring hammer |
| 51 | supporting table |
| 52 | stamp |
| 53 | pendulum bearing |
| 54 | base frame |
| 55 | feeding cylinder |
| 56 | brake |
| 57 | brake backplate |
| 58 | brake shoes |
| 59 | holding |

The invention claimed is:

1. A decoring machine (1) for decoring cast workpieces (2), comprising:

a machine frame (3), which is installable at a machine base (4);

a machine table (6), which is coupled to the machine frame (3) by means of a mounting bracket (7), wherein the machine table (6) is mounted by means of the mounting bracket (7) so as to be movable relative to the machine frame (3) at least in a main direction of movement (5);

a first eccentric mass (10), which is mounted in a rotatable manner on the machine table (6);

a second eccentric mass (12), which is mounted in a rotatable manner on the machine table (6), wherein the second eccentric mass (12) is driven in the opposite direction to the first eccentric mass (10);

a workpiece carrier (21) for receiving the cast workpiece (2) to be decored, wherein the workpiece carrier (21) is coupled to the machine table (6) by means of a rotary mounting (22), wherein the rotary mounting (22) is configured in such a way that the workpiece carrier (21) is mounted so as to be rotatable about a horizontal axis of rotation (23) relative to the machine table (6).

2. The decoring machine according to claim 1, wherein the mounting bracket (7) comprises a leaf spring (8), wherein the leaf spring (8) is coupled to the machine frame (3) at its two longitudinal ends by means of a revolute joint (9) and is coupled to the machine table (6) in the area of its longitudinal center.

3. The decoring machine according to claim 1, wherein the rotary mounting (22) is configured in the form of a slewing ring.

4. The decoring machine according to claim 1, wherein a rotary drive (24) is configured, by means of which the workpiece carrier (21) is rotatable relative to the machine table (6).

5. The decoring machine according to claim 4, wherein the rotary drive (24) comprises a drive motor (25) having a rotary drive pulley (43) and a traction means (44) slung around the rotary drive pulley (43), wherein the drive motor (25) is accommodated at the machine frame (3), wherein the traction means (44) is coupled to the workpiece carrier (21).

6. The decoring machine according to claim 5, wherein the traction means (44) has a first longitudinal end (47) and a second longitudinal end (48), wherein the first longitudinal end (47) and the second longitudinal end (48) are respectively connected to the workpiece carrier (21) and wherein the rotary drive pulley (43) is arranged between the first longitudinal end (47) and the second longitudinal end (48).

7. The decoring machine according to claim 1, wherein at least one of the eccentric masses (10) is coupled to an eccentric drive motor (14), wherein the eccentric drive motor (14) is arranged at the machine frame (3).

8. The decoring machine according to claim 7, wherein a drive pulley (15) is arranged at the eccentric drive motor (14) and a driven pulley (11) is arranged at the eccentric mass (10), wherein a drive belt is slung around the drive pulley (15) and the driven pulley (11), wherein a straight line (17) drawn between the axis of rotation (18) of the drive pulley (15) and the axis of rotation (19) of the driven pulley (11) is at an angle (20) of between 85° and 95° to the main direction of movement (5) of the machine table (6).

9. The decoring machine according to claim 1 wherein the two eccentric masses (10, 12) are rotationally connected to each other by means of a synchronization means (36).

10. The decoring machine according to claim 9, wherein the first eccentric mass (10) is coupled to a first synchronization disc (37) and the second eccentric mass (12) is coupled to a second synchronization disc (38), wherein the synchronization means (36) comprises a synchronization belt (39), which is deflected around deflection sheaves (40) in such a way that an interior side (41) of the synchronization belt (39) is in operative connection with the first synchronization disc (37) and an exterior side (42) of the synchronization belt (39) is in operative connection with the second synchronization disc (38).

11. The decoring machine according to claim 1, wherein at least one decoring hammer (50) is arranged at the workpiece carrier (21), which decoring hammer (50) has a hammer head configured to act upon a workpiece.

12. The decoring machine according to claim 11, wherein the decoring hammer (50) is arranged at the workpiece carrier (21) in such a way that an effective direction of the decoring hammer (50) is parallel to the main direction of movement (5).

13. The decoring machine according to claim 11 wherein the decoring hammer (50) is shiftable in a direction transverse to the main direction of movement (5) relative to the workpiece carrier (21).

14. The decoring machine according to claim 11, wherein the decoring hammer (50) is shiftable in the main direction of movement (5) relative to the workpiece carrier (21).

15. The decoring machine according to claim 11, wherein two decoring hammers (50) are arranged at the workpiece carrier (21), wherein the workpiece carrier (21) has a supporting table (51) mounted to a base frame (54) of the workpiece carrier (21) by means of a pendulum bearing (53).

16. The decoring machine according to claim 1, wherein a brake (56) is configured, by means of which the machine table (6) can be braked relative to the machine frame (3).

17. A method for producing cast workpieces (2) by means of the decoring machine (1) according to claim 1, wherein the method comprises the following process steps:

clamping the cast workpiece (2) at the workpiece carrier (21);

vibrating the cast workpiece (2) by moving the machine table (6) including the workpiece carrier (21) in the main direction of movement (5) relative to the machine frame (3);

removing the molding sand from the cast workpiece (2) by rotating the workpiece carrier (21) about a horizontal axis of rotation (23) relative to the machine table (6).

18. The method according to claim 17, wherein, during the vibrating of the cast workpiece (2) by moving the machine table (6) including the workpiece carrier (21) relative to the machine frame (3) in the main direction of movement (5), the cast workpiece (2) is simultaneously acted upon by means of at least one decoring hammer (50).

* * * * *